US007924238B2

(12) United States Patent
Saito et al.

(10) Patent No.: US 7,924,238 B2
(45) Date of Patent: Apr. 12, 2011

(54) IMAGE FORMING APPARATUS WITH MEMBERS THAT BRING A LIGHT EMITTING DEVICE IN PROXIMITY TO A RECORDING MEDIUM

(75) Inventors: Yasunori Saito, Kanagawa (JP); Ikutaroh Nagatsuka, Kanagawa (JP); Tsutomu Ishii, Kanagawa (JP); Minoru Koshimizu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1372 days.

(21) Appl. No.: 11/264,172

(22) Filed: Nov. 2, 2005

(65) Prior Publication Data

US 2006/0251380 A1 Nov. 9, 2006

(30) Foreign Application Priority Data

May 9, 2005 (JP) ..... 2005-135861

(51) Int. Cl.
*G09G 3/20* (2006.01)

(52) U.S. Cl. ..... 345/55; 347/111

(58) Field of Classification Search ..... 349/25–30; 358/471–475; 345/104–11, 4–6, 55; 400/83–85; 347/111

See application file for complete search history.

(56) References Cited

U.S. PATENT DOCUMENTS

| | | | | |
|---|---|---|---|---|
| 5,068,688 | A * | 11/1991 | Tanabe | 355/99 |
| 2004/0056942 | A1* | 3/2004 | Kobayashi | 347/111 |
| 2005/0185375 | A1* | 8/2005 | Ito | 361/685 |

FOREIGN PATENT DOCUMENTS

| | | | |
|---|---|---|---|
| JP | 2001301233 A | * | 10/2001 |
| JP | A 2001-301233 | | 10/2001 |
| JP | 2004106495 A | * | 4/2004 |
| JP | A 2004-106495 | | 4/2004 |
| JP | 2004173088 A | * | 6/2004 |

* cited by examiner

*Primary Examiner* — Amr Awad
*Assistant Examiner* — Liliana Cerullo
(74) *Attorney, Agent, or Firm* — Oliff & Berridge, PLC

(57) ABSTRACT

An image forming apparatus writes an image to a display recording medium at a write position. The image forming apparatus includes an insertion slot, a transport unit, an image light emitting device and a separating/contacting unit. The display recording medium is inserted into the insertion slot. The transport unit transports the display recording medium inserted, to/from the write position. The image light emitting device includes an emitting surface that emits two-dimensional image light for irradiating a photoconductive layer of the display recording medium at the write position. The separating/contacting unit brings the emitting surface separate from a display recording medium surface when the display recording medium is not opposed to the image light emitting device, while the transport unit transports the display recording medium. The separating/contacting unit brings the emitting surface into proximity to the display recording medium surface when the display recording medium is at the write position.

18 Claims, 15 Drawing Sheets

IMAGE FORMING APPARATUS WITH MEMBERS THAT BRING A LIGHT EMITTING DEVICE IN PROXIMITY TO A RECORDING MEDIUM

BACKGROUND OF THE INVENTION

1. Field of the Invention

The present invention relates to an image forming apparatus that writes an image to a display recording medium capable of displaying the image without power, by irradiating the display recording medium with image light.

2. Description of the Related Art

As a display recording medium, in addition to a paper medium and an electronic display device, attention has recently been paid to a display recording medium (also called digital paper) combining the advantage of an electronic display and that of paper.

This display recording medium has memorability in display. Therefore, it is only necessary that an image write device gives write energy to the display recording medium only when information is rewritten, and there is no need to give it any energy for maintaining the display. Accordingly, after the information is written, it is possible to separate the display recording medium from the image write device, and thus it is possible, like the paper medium, to readily carry it about and read the information with a plurality of the display recording media stacked one on another, placed side by side, or carried in hand.

As the display recording medium having memorability, there are known a light write type display recording medium into which an image is visibly and erasably stored by light irradiation and voltage application, and an image write device that writes an image to this display recording medium (e.g., see JP-A-2001-301233 ([0031] to [0043] and FIGS. 1 and 2)).

In this display recording medium described in Patent Document 1, a liquid crystal layer and a photoconductive layer that varies in resistance value under light irradiation are laminated to each other between a pair of transparent electrodes. Besides, the image write device that writes an image to the display recording medium is configured as follows. That is, the photoconductive layer of the display recording medium is irradiated with a two-dimensional light pattern via a two-dimensional microlens array from an LCD (liquid crystal display) panel so that the light pattern is focused onto the photoconductive layer. A resistance distribution based on the light pattern is thus generated in the photoconductive layer. A voltage is then applied between the transparent electrodes via receiving ends, thereby applying to the liquid crystal layer a voltage distribution based on the resistance distribution of the photoconductive layer. An image responsive to the voltage distribution is thus recorded on the liquid crystal layer.

According to the image write device of the light write type display recording medium, printing is enabled by exposing image information in a planar fashion while applying a voltage to the entire pair of electrodes. Therefore, this makes it possible to write large-capacity image information at high speed as compared with line exposure and scan exposure.

SUMMARY OF THE INVENTION

However, according to the existing image write device, in the case of recording an image to the display recording medium as transported below a write portion, when the display recording medium is transported in close contact with the LCD panel, in some cases, the LCD panel is scraped and scratched on its surface or, what is worse, the LCD panel is thereby damaged. Accordingly, it is preferred that the display recording medium and the LCD panel make no close contact with each other during transport of the display recording medium and it is preferred that make close contact with each other during printing or that a narrow gap is formed between the display recording medium and the LCD panel during printing.

On the other hand, as the configuration of preventing the scrape between display recording medium and the LCD panel, the following lift mechanism can be considered. That is, the display recording medium inserted in the image write device is transported by a transport mechanism so as to be kept out of contact with the LCD panel, and the display recording medium surface is thus brought into proximity to the LCD panel side when opposed to the LCD panel. However, the transport mechanism for transporting the display recording medium to a portion thereof opposite the LCD panel need to be in conjunction with a separating/contacting mechanism for bringing the display recording medium out of and into contact with the LCD panel. Therefore, the transport mechanism must be moved up and down in conjunction not only with the display recording medium separating/contacting mechanism but also with part of the transport path of the display recording medium transport mechanism. Thus, there is the problem in which the apparatus is complicated in configuration and particularly is increased in thickness in a separating/contacting direction that is the direction of the display recording medium surface, which is likely to hinder a reduction in thickness of the apparatus.

The present invention has been made in view of the above circumstances and provides an image forming apparatus that is of small size and is configured to prevent an image light emitting device from being damaged by a display recording medium being transported.

The present invention may provide an image forming apparatus for writing an image to a display recording medium at a write position. The recording medium has a photoconductive layer and a display layer laminated to each other. The display layer displays in response to an electric field distribution generated by two-dimensional image light irradiated on the photoconductive layer. The apparatus includes an insertion slot, a transport unit, an image light emitting device and a separating/contacting unit. The display recording medium is inserted into the insertion slot. The transport unit transports the display recording medium inserted through the insertion slot, into and out of the write position. The image light emitting device includes an emitting surface that emits the two-dimensional image light for irradiating the photoconductive layer at the write position. The separating/contacting unit brings the emitting surface separate from a display recording medium surface when the display recording medium is not opposed to the image light emitting device, while the display recording medium is transported by the transport unit. And the separating/contacting unit brings the emitting surface into proximity to the display recording medium surface when the display recording medium is at the write position, while the display recording medium is transported by the transport unit.

BRIEF DESCRIPTION OF THE DRAWINGS

Preferred embodiments of the present invention will be described in detail based on the following figures, wherein:

FIGS. 4A to 4C are section views showing respective portions of the image write unit in FIG. 3, wherein FIG. 4A is a section view taken along line A-A, FIG. 4B is a section view taken along line B-B, and FIG. 4C is a section view taken along line C-C;

FIGS. 8A to 8E are views showing an image write unit according to a third embodiment of the invention, wherein FIG. 8A is a front view showing the state of the image write unit before the display recording medium is transported in, FIG. 8B is a front view showing the state of the image write unit immediately after the display recording medium is inserted, FIG. 8C is a front view showing the state of the image write unit after the display recording medium is completed being transported in, FIG. 8D is a section view taken along line 8D-8D of FIG. 8A, and FIG. 8E is a section view taken along line 8E-8E of FIG. 8A;

FIGS. 9A to 9E are views showing an image write unit according to a fourth embodiment of the invention, wherein FIG. 9A is a front view showing the state of the image write unit before the display recording medium is transported in, FIG. 9B is a front view showing the state of the image write unit immediately after the display recording medium is inserted, FIG. 9C is a front view showing the state of the image write unit after the display recording medium is completed being transported in, FIG. 9D is a section view taken along line 9D-9D of FIG. 9A, and FIG. 9E is a section view taken along line 9E-9E of FIG. 9A;

FIGS. 12A to 12C are views showing the configuration of an image write unit according to a seventh embodiment of the invention, wherein FIG. 12A is a section view taken along line A-A of FIG. 3, FIG. 12B is a section view taken along line B-B of FIG. 3, and FIG. 12C is a section view taken along line C-C of FIG. 3;

FIGS. 14A to 14C are views showing an image write unit according to a ninth embodiment of the invention, wherein FIG. 14A is a plan view, FIG. 14B is a front view showing the state of the image write unit after the display recording medium is inserted, and FIG. 14C is a front view showing the state of the image write unit after the display recording medium is completed being transported in.

DETAILED DESCRIPTION OF THE INVENTION

First Embodiment

Figure 1:
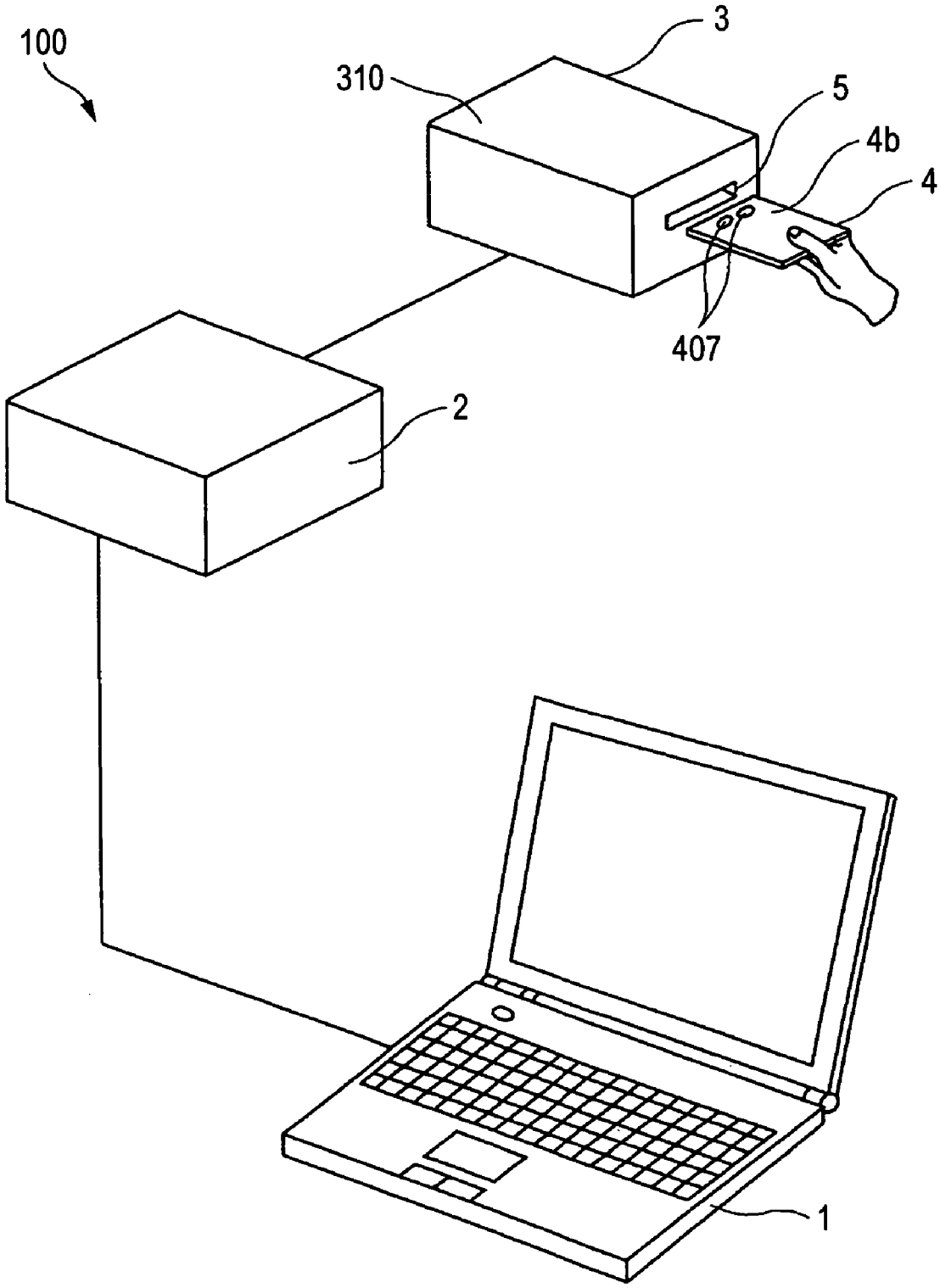
FIG. 1 is a perspective view showing an image forming apparatus according to a first embodiment of the invention.

FIG. 1 shows the outline of an image forming apparatus according to a first embodiment of the invention. This image forming apparatus 100 includes a personal computer (PC) 1, a controller 2 connected to this PC 1, and an image write unit 3 that writes an image to a display recording medium 4 under control of the controller 2. Additionally, the PC 1 and the controller 2 may be configured into a single write instruction device.

The PC 1 transfers to the controller 2 image data to be written to the display recording medium 4 and gives the controller 2 an image write instruction. The image data transferred to the controller 2 includes image data created by operating the keyboard, mouse, and the like of this PC 1 and image data acquired from the external via a recording medium or a network.

The image write unit 3, having a substantially box-like casing 310, has an insertion slot which is horizontally formed at the front of the casing 310 and through which the display recording medium 4 is inserted and discharged. Additionally, the image write unit 3 may be configured to have the insertion slot 5 formed in a vertical direction.

Figure 2:
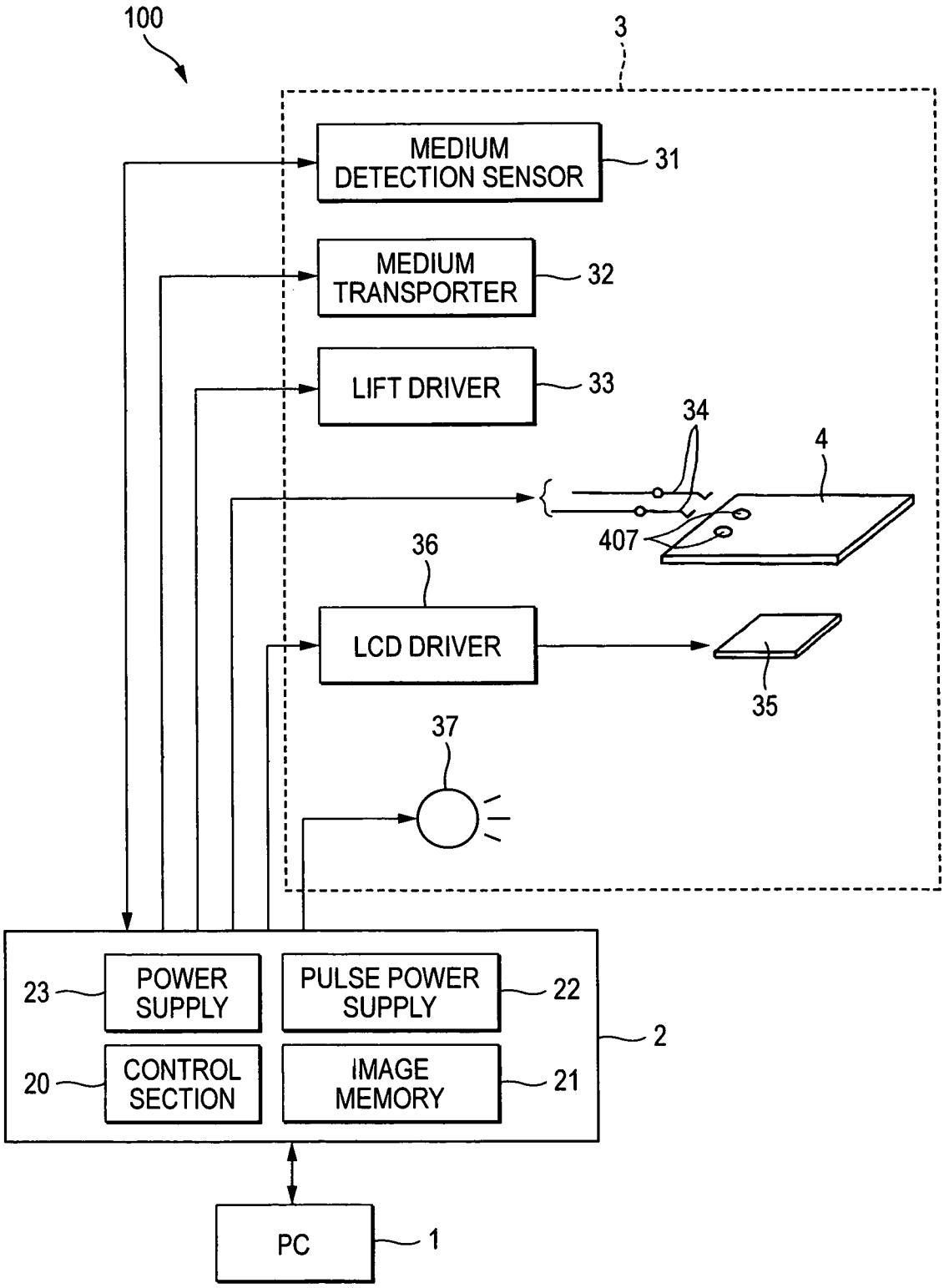
FIG. 2 is a block diagram showing the control system configuration of a controller and image write unit in FIG. 1.

FIG. 2 shows the detailed configuration of the interior of the controller 2 and image write unit 3.

The image write unit 3 includes a medium detection sensor 31, a medium transporter 32, an LCD panel 35, a lift driver 33, a pair of leads 34, an LCD driver 36, and a light source 37. The medium detection sensor 31 is made up of a light emitting element and light receiving element which optically detect that the display recording medium 4 has been inserted to a predetermined position from the insertion slot 5. The medium transporter 32 transports the inserted display recording medium 4 into a write position, and transports the display recording medium 4 written with an image out of the insertion slot 5. The LCD panel 35 serves as the image light emitting device that irradiates the display recording medium 4 with image light. The lift driver 33 serves as the separating/contacting unit that separates a LCD holder described as follows, which holds the LCD panel 35, from the write position for writing to the display recording medium 4. The pair of leads 34 is capable of contacting a pair of receiving ends 407 of the display recording medium 4. The LCD driver 36 drives the LCD panel 35. And, the light source 37 is made up of an LED or the like that serves as a backlight of the LCD panel 35.

The controller 2 includes a control section 20 configured by using a CPU or the like, an image memory 21 that stores the image data, a pulse power supply 22 that generates a drive voltage to be applied to the display recording medium 4, and a power supply 23 that supplies power to each section of the image write unit 3.

The control section 20 is configured to control the lift driver 33 in conjunction with the transport of the display recording medium 4 into/out of the write position.

Figure 3:
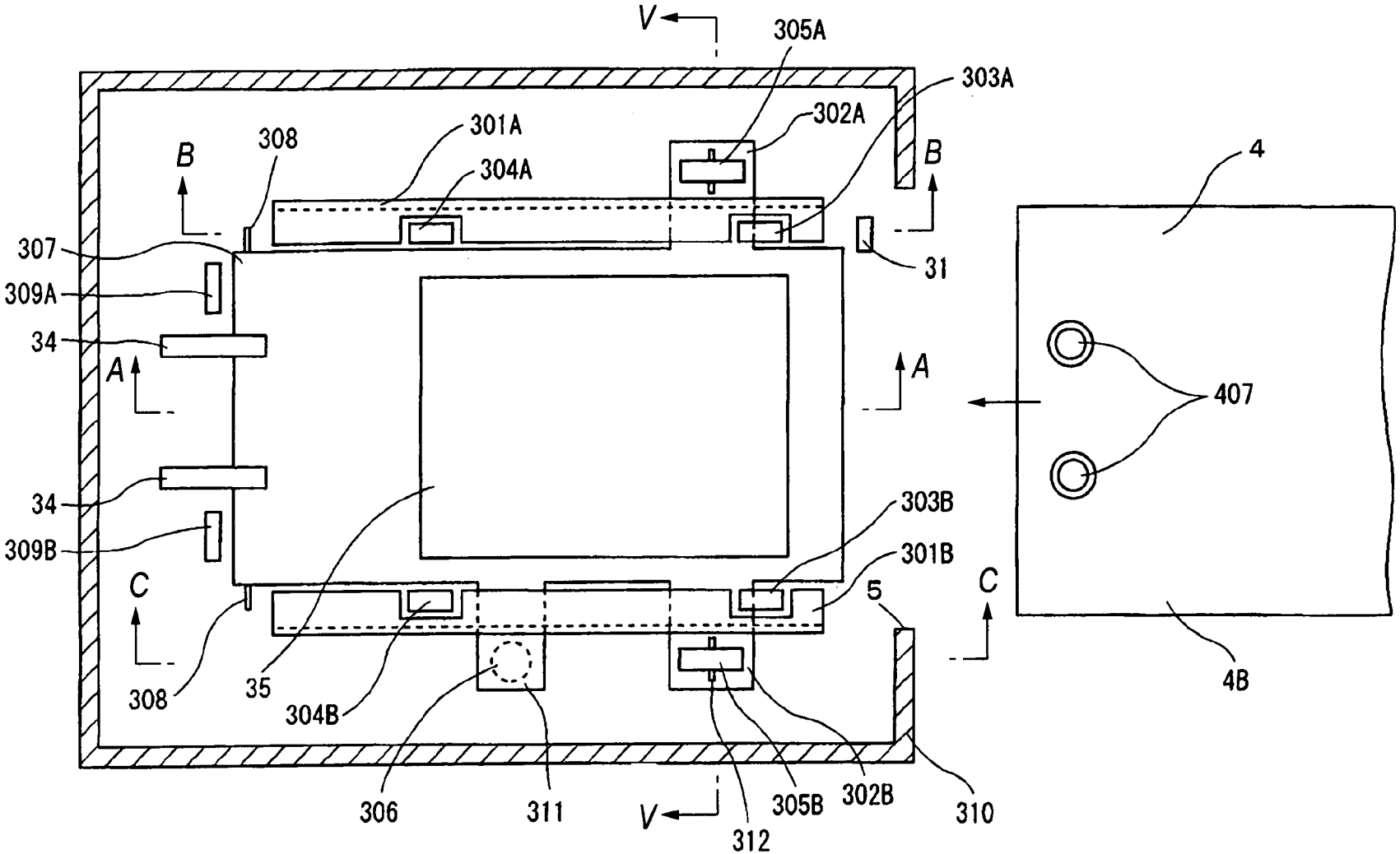
FIG. 3 is a plan view showing the internal configuration of the image write unit in FIG. 1.
Figure 4A:
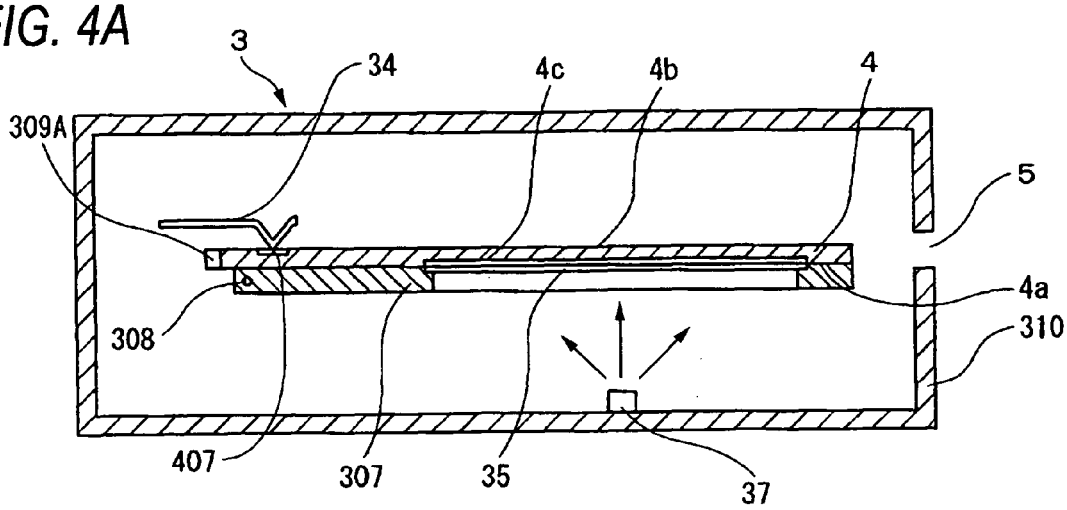
Figure 4B:
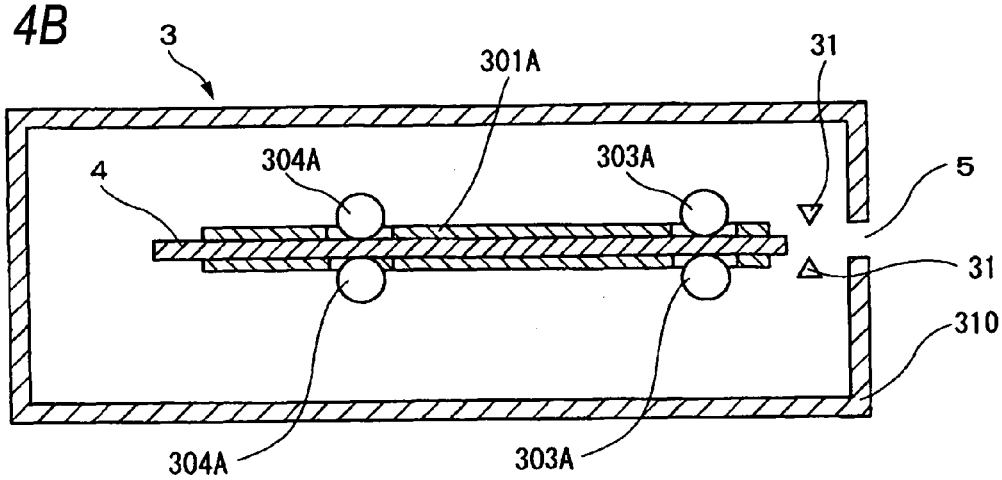
Figure 4C:
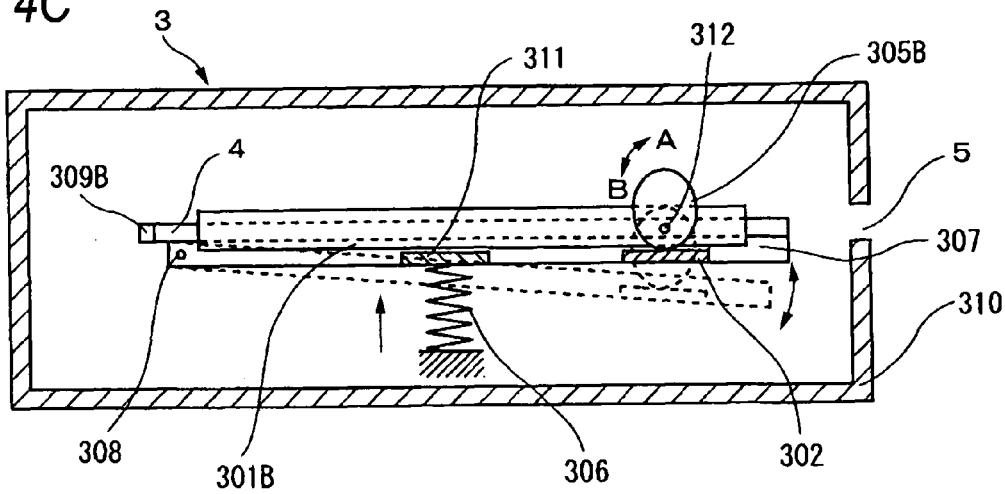
Figure 5:
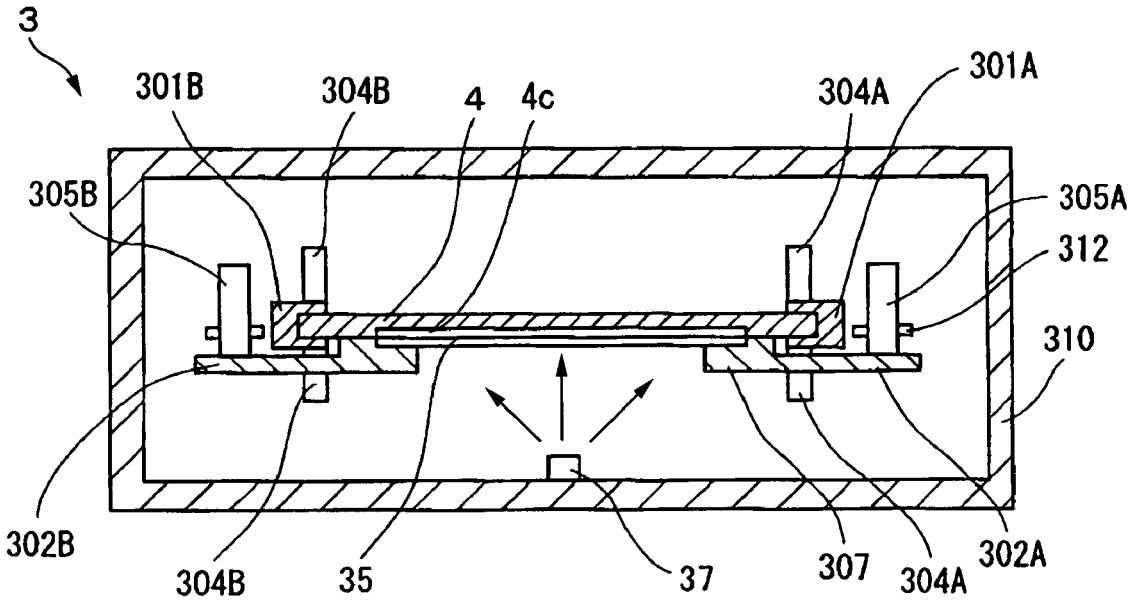
FIG. 5 is a section view taken along line 5-5 of FIG. 3.

FIG. 3 shows the display recording medium 4 and the internal configuration of the image write unit 3. Besides, FIG. 4 shows section views of respective portions of the image write unit 3 in FIG. 3, wherein FIG. 4A is a section view taken along line A-A of FIG. 3, FIG. 4B is a section view taken along line B-B of FIG. 3, and FIG. 4C is a section view taken along line C-C of FIG. 3. Furthermore, FIG. 5 is a section view taken along line 5-5 of FIG. 3.

The medium transporter 32 includes a pair of guide members 301A and 301B having a linear U cross-section shape, transport rollers 303A, 303B, 304A, and 304B, stoppers 309A and 309B, and a not-shown transport motor. The pair of guide members 301A and 301B, disposed one on each side of the interior of the casing 310, guide the display recording medium 4 inserted from the insertion slot 5. The transport rollers 303A, 303B, 304A, and 304B are disposed, facing a display recording medium 4 transport path, in notches formed in the pair of guide members 301A and 301B. The stoppers 309A and 309B stop the transported display recording medium 4. And, the not-shown transport motor rotationally drives the transport rollers 303A, 303B, 304A, and 304B.

The LCD holder 307 that holds the LCD panel 35 is rotatably supported by rotary shafts 308 projecting from both side surfaces on the sides thereof in the transport-in direction of the display recording medium 4. A projecting piece 311 that engages the upper end of a compression spring 306 is provided on one side surface of the LCD holder 307 at the center thereof. And, projecting pieces 302A and 302B that receive eccentric cams 305A and 305B are provided on both side surfaces of the LCD holder 307 on the front end side thereof. Additionally, the configuration may be such that the projecting pieces 311 are provided on each of the right and left sides of the LCD holder 307, and thus such that the LCD holder 307 are pressed by the right and left compression springs 306. This can provide a balanced pressing force to the LCD holder 307.

The lift driver 33 includes the compression spring 306, the eccentric cams 305A and 305B, and a not-shown lift motor. The compression spring 306 upwardly presses the projecting piece 311 of the LCD holder 307. The eccentric cams 305A and 305B are rotatably supported on rotary shafts 312 and depress the projecting pieces 302A and 302B provided on the LCD holder 307 in response to their rotation. And, the not-shown lift motor rotates the eccentric cams 305A and 305B.

Figure 6:
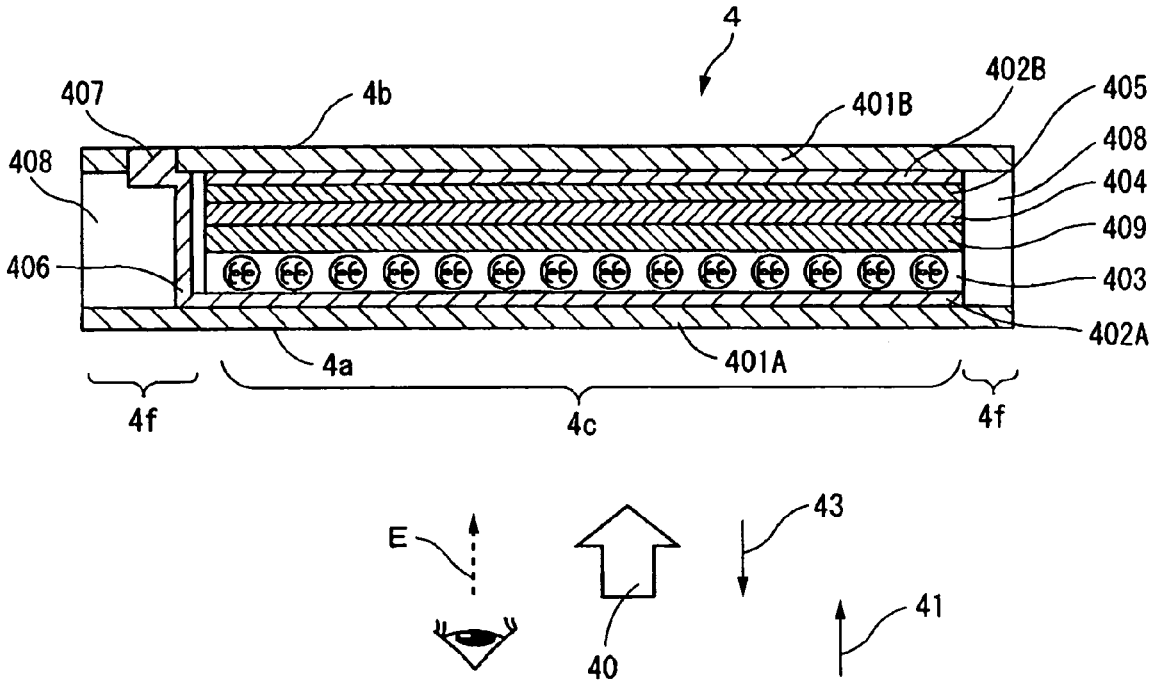
FIG. 6 is a section view showing the layer configuration of the display recording medium of the first embodiment.

FIG. 6 shows the layer structure of the display recording medium 4. This display recording medium 4 includes a pair of transparent substrates 401A and 401B, a pair of transparent electrodes 402A and 402B, a liquid crystal layer 403, a photoconductive layer 404, a light absorption layer 405, an extending portion 406, the pair of receiving ends 407, a resin-filled portion 408, and a separation layer 409. The pair of transparent substrates 401A and 401B, made of PET (polyethylene terephthalate) films, is disposed opposite each other. The pair of transparent electrodes 402A and 402B, made of ITO (indium tin oxide), are provided on the inner sides of the pair of substrates 401A and 401B. The liquid crystal layer 403 is provided on the inner side of the transparent electrode 402A and is made of cholesteric liquid crystals that vary in reflectance (transmittance) according to an applied voltage. The photoconductive layer 404 is disposed on the inner side of the transparent electrode 402B and is formed so that its resistance decreases as an image write display region 4*c* serving as a display surface is irradiated with write pattern light 40. The light absorption layer 405 is provided between the transparent electrode 402B and the photoconductive layer 404. The extending portion 406 extends from the transparent electrode 402B to the side of a rear surface 4*b*. The pair of receiving ends 407 is formed to be connected to the transparent electrode 402A and the extending portion 406. The resin-filled portion 408 is filled with a resin to fill the gap between the substrates 401A and 401B. And, the separation layer 409 is provided between the liquid crystal layer 403 and the photoconductive layer 404. Besides, the display recording medium 4 has a support body having a display surface and a frame which disposed adjacently to and co-planarly with the display surface.

(Operation of Image Forming Apparatus)

The operation of the image forming apparatus 100 will now be described with reference to FIGS. 1 to 6.

(1) Insertion of Display Recording Medium

First, as shown in FIG. 1, a user inserts the display recording medium 4 into the insertion slot 5 of the image write unit 3 with the receiving ends 407 facing up and the insertion side. When the display recording medium 4 is inserted to the predetermined position, the medium detection sensor 31 detects the insertion and transmits a medium detection signal to the controller 2.

(2) Separation of LCD Holder from Write Position

The control section 20 of the controller 2 rotationally drives the not-shown lift motor of the lift driver 33 in a forward direction, based on the medium detection signal from the medium detection sensor 31. As shown in FIG. 4C, the cams 305A and 305B are thus rotated about the rotary shaft 308 from direction A to B to incline the LCD holder 307 from the solid line position to dashed line position of FIG. 4C against the spring force of the compression spring 306. That is, the control section 20 separates the LCD holder 307 from the write position.

(3) Transport-in of Display Recording Medium

The control section 20 rotationally drives the not-shown transport motor of the medium transporter 32 in a forward direction at the same time as driving the lift driver 33 or after a predetermined time elapses from the start of driving the lift driver 33. The transport rollers 303A, 303B, 304A, and 304B are thus rotated to transport the display recording medium 4 into the back of the image write unit 3. The control section 20 stops the rotation of the transport rollers 303A, 303B, 304A, and 304B with such timing that the display recording medium 4 is transported and one to two seconds elapses after the leading end thereof abuts the stoppers 309A and 309B. On this occasion, the leads 34 are placed in contact with the receiving ends of the display recording medium 4.

(4) Rotation of LCD Holder to Write Position

The control section 20 rotationally drives the lift motor of the lift driver 33 in a reverse direction. The cams 305A and 305B are thus rotated from direction B to A to rotate the LCD holder 307 from the dashed line position to solid line position of FIG. 4C. The LCD holder 307 is upwardly pressed around the rotary shafts 308 by the spring force of the compression spring 306, and the LCD panel 35 is thus positioned parallel to the display recording medium 4. That is, the control section 20 positions the LCD holder 307 at the write position. On this occasion, the image write display region 4*c* of the display recording medium 4 is opposed to the LCD panel 35 with a slight gap (e.g., 100 to 500 μm) provided therebetween. Additionally, the image write display region 4*c* may make close contact with the LCD panel 35.

(5) Image Write

Next, the user operates the PC 1 to select an image intended to be written to the display recording medium 4 and thus sends its image data and write instruction to the controller 2. The controller 2 stores into the image memory 21 the image data transmitted from the PC 1 and also starts a write in accordance with the write instruction.

The control section 20 of the controller 2 actuates the power supply 21 to turn on the light source 37. Besides, the control section 20 actuates the pulse power supply 22 to apply an initialization voltage for initializing the display recording medium 4, between the pair of receiving ends 407 before a normal write operation. As the initialization voltage is thus applied, total white or total black is displayed in the image write display region 4*c* of the display recording medium 4. On this occasion, the LCD driver 36 is not actuated. Additionally, total white or total black may be displayed by applying the initialization voltage with the LCD driver 36 actuated.

After the initialization is completed, the control section 20 applies a predetermined voltage to the pair of receiving ends 407 of the display recording medium 4 via the pair of leads 34 from the pulse power supply 22. The control section 20 simultaneously supplies the LCD driver 36 with a write signal responsive to the image data stored by the image memory 21.

The LCD driver 36 drives the LCD panel 35 based on the write signal to irradiate the image write display region 4*c* of the display recording medium 4 with the write pattern light 40.

The write pattern light 40, with which the image write display region 4*c* of the display recording medium 4 is irradiated, reaches the photoconductive layer 404 via the substrate 401A, transparent electrode 402A, liquid crystal layer 403, and separation layer 409. The light irradiated portion of the photoconductive layer 404 decreases in resistance value, whereby the liquid crystal layer 403 increases in voltage which is determined by an impedance ratio with respect to the photoconductive layer 404, and thus increases in photo reflectance. Accordingly, while a front surface 4*a* of the display recording medium 4 is being irradiated with illumination light 41, the region of the liquid crystal layer 403 which is irradiated with the write pattern light 40 increases in reflectance, and thus reflects the illumination light 41 and looks white. In contrast, the region which is not irradiated with the write pattern light 40 looks black since the illumination light 41 is transmitted through the liquid crystal layer 403 and absorbed by the light absorption layer 405, and reflected light 43 can be seen as an image from direction E. This image is held for a long time even after extinction of the voltage application to the receiving ends 407.

(6) Separation of LCD Holder from Write Position

Upon completion of the operation of writing to the display recording medium 4 by the LCD driver 36, the control section 20 rotationally drives the not-shown lift motor of the lift driver 33 in the forward direction. As shown in FIG. 4C, the cams 305A and 305B are thus rotated about the rotary shafts 308 from direction A to B to incline the LCD holder 307 from the solid line position to dashed line position of FIG. 4C.

(7) Transport-out of Display Recording Medium

The control section 20 rotationally drives the not-shown transport motor of the medium transporter 32 in a reverse direction at the same time as driving the lift driver 33 or after a predetermined time elapses from the start of driving the lift driver 33. The transport rollers 303A, 303B, 304A, and 304B are thus rotated in reverse to transport the display recording medium 4 out to the insertion slot 5. The control section 20 stops the rotation of the transport rollers 303A, 303B, 304A, and 304B as the medium detection sensor 31 detects the passage of the display recording medium 4.

(8) Rotation of LCD Holder to Write Position

After stopping the transport motor, the control section 20 rotationally drives the lift motor of the lift driver 33 in the reverse direction. The cams 305A and 305B are thus rotated from direction B to A to rotate the LCD holder 307 from the dashed line position to solid line position of FIG. 4C.

(9) Take-out of Display Recording Medium

The user pulls out the display recording medium 4 exposed out of the insertion slot 5, by hand, from the image write unit 3. The write to the display recording medium 4 is completed therewith and, under the illumination light 41, the user can observe an image formed by a letter or still image that is written to the image write display region 4*c* of the display recording medium 4.

According to the first embodiment, during transport of the display recording medium 4 into or out of the write position, the LCD holder 307 is separated from the write position, thereby making it harder for the surface of the LCD panel 35 to be scratched. Besides, the LCD holder 307 is rotated to separate it from the write position, thus enabling a simplification in configuration and a reduction in size of the apparatus. Furthermore, the display recording medium 4 provides the front surface 4*a* with a write surface and an observation surface, so that a rear surface 4*b* can be used as a print surface. Besides, the transport rollers 303A, 303B, 304A, and 304B are disposed so as not to pass over the image write display region 4*c* of the display recording medium 4, thus making it possible to prevent the image write display region 4*c* from being damaged. Furthermore, the compression spring 306 is disposed at a position farther away from the rotary shafts 308 than the center of the LCD panel 35, so that a small spring force will be suffice, which can reduce the rigidity of the LCD holder 307.

Second Embodiment

Figure 7:
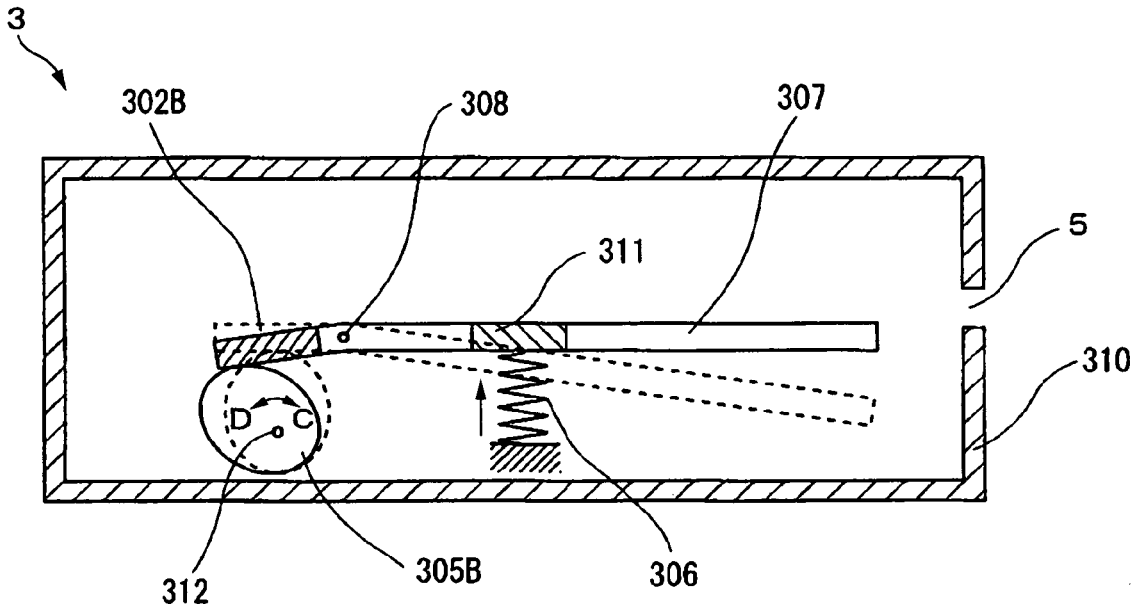
FIG. 7 is a front section view showing the configuration of an image write unit according to a second embodiment of the invention.

FIG. 7 shows an image write unit according to a second embodiment of the invention. The second embodiment is configured different from the first embodiment in the following respect. That is, the projecting pieces 302A and 302B and the cams 305A and 305B are disposed nearer the side of the LCD holder 307 in the advancing direction of the display recording medium 4. And, the projecting piece 311 and the compression spring 306 are disposed at the center of the LCD holder 307. Furthermore, the rotary shafts 308 are disposed nearer the center of the LCD holder 307 instead of at the end thereof. And, the other configuration is the same as that of the first embodiment. Additionally, in FIG. 7, the guide members 301A and 301B and the like are omitted from the illustration.

In this second embodiment, when the display recording medium 4 is transported into the write position, the control section 20 and the lift driver 33 rotate the cams 305A and 305B in direction C. End portions of the LCD holder 307 on the sides of the stoppers 309A and 309B are thereby lifted, and end portions of the LCD holder 307 on the transport-in side of the display recording medium 4 are thus lowered against the spring force of the compression spring 306. The entire LCD holder 307 is thereby inclined, thus forming a space between the LCD holder 307 and the display recording medium 4 transported in.

When the display recording medium 4 is transported into the write position, the cams 305A and 305B are rotated in direction D, and the LCD holder 307 is pushed up by the compression spring 306 to bring the LCD panel 35 into proximity to or into close contact with the display recording medium 4.

According to this second embodiment, similar to the first embodiment, the surface of the LCD panel 35 can be prevented from being scratched, and the cams 305A and 305B are disposed rearwardly of the LCD holder 307, so that the image write unit 3 can be reduced in size in its width direction.

Third Embodiment

Figure 8A:
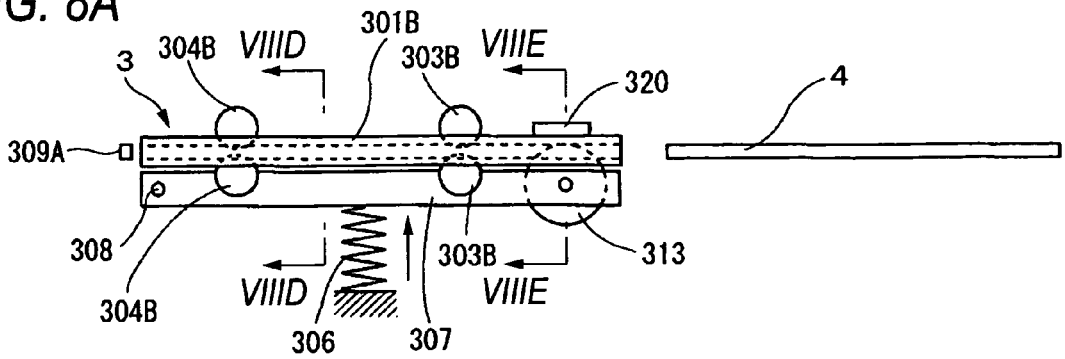
Figure 8B:
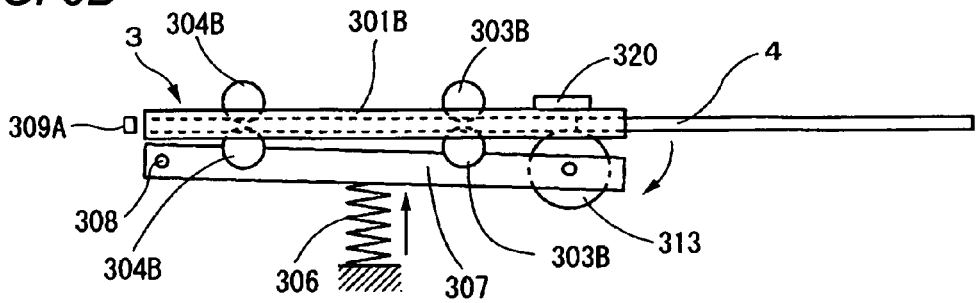
Figure 8C:
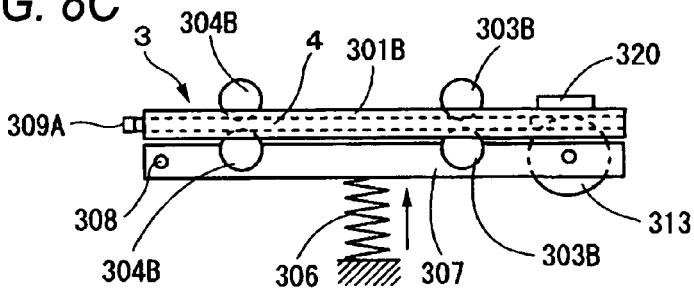
Figure 8D:
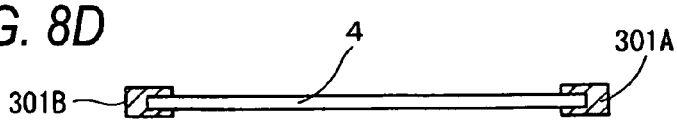
Figure 8E:
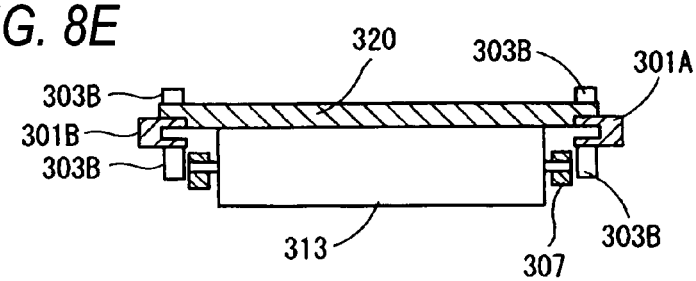

FIG. 8A to 8E show an image write unit according to a third embodiment of the invention. FIG. 8A shows the state of the image write unit before the display recording medium 4 is transported in; FIG. 8B shows the state of the image write unit immediately after the display recording medium 4 is inserted; FIG. 8C shows the state of the image write unit after the display recording medium 4 is completed being transported in; FIG. 8D is a section view taken along line 8D-8D of FIG. 8A; and FIG. 8E is a section view taken along line 8E-8E of FIG. 8A.

This third embodiment is configured different from the first embodiment in the following respect. That is, the projecting pieces 302A and 302B are eliminated from the LCD holder 307 and, furthermore, the cams 305A and 305B are eliminated. In addition thereto, a lift roller 313 serving as the rotary member is disposed in an end portion of the LCD holder 307 on the insertion side of the display recording medium 4, and a receiving member 320 that receives the lift roller 313 is attached to the guide members 301A and 301B. The other configuration is the same as that of the first embodiment.

The lift roller 313, made up of a non-metal material such as rubber or plastic, is rotatably attached to the LCD holder 307.

(Operation of Image Forming Apparatus)

The operation of the image forming apparatus 100 will now be described.

(1) Insertion of Display Recording Medium

When, as shown in FIG. 8A, the display recording medium 4 is inserted between the guide members 301A and 301B from the right as seen in the figure, as shown in FIG. 8B, the leading end of the display recording medium 4 rides over the lift roller 313 and thus depresses the lift roller 313 against the spring force of the compression spring 306. A gap of such a size that the display recording medium 4 makes no contact with the surface of the LCD panel 35 is thereby provided under the lower surface of the display recording medium 4.

(2) Transport-in of Display Recording Medium

When the display recording medium 4 is further inserted and the medium detection sensor 31 detects the further insertion, the control section 20 drives the not-shown transport motor to rotate the transport rollers 303A, 303B, 304A, and 304B. The leading end of the display recording medium 4 abuts the stopper 309A, and the display recording medium 4 is thus transported to the write position shown in FIG. 8C. Simultaneously therewith, the LCD holder 307 is brought into proximity to or into close contact with the display recording medium 4 by the spring force of the compression spring 306.

(3) Image Write

Next, the user operates the PC 1 to select an image intended to be written to the display recording medium 4. When the user then gives an instruction to write the image, similar to the first embodiment, the display recording medium 4 is initialized, and thereafter the image is written to the image write display region 4*c* of the display recording medium 4.

(4) Transport-out of Display Recording Medium

Upon completion of the operation of writing to the display recording medium 4 by the LCD driver 36, the control section 20 rotationally drives the transport motor of the medium transporter 32 in the reverse direction. The transport rollers 303A, 303B, 304A, and 304B are thus rotated in reverse to transport the display recording medium 4 out to the insertion slot 5. The control section 20 stops the rotation of the transport rollers 303A, 303B, 304A, and 304B as the medium detection sensor 31 detects the passage of the display recording medium 4. On this occasion, the display recording medium 4 becomes supported and sandwiched between the lift roller 313 and the receiving member 320.

(5) Take-out of Display Recording Medium

The user pulls out the display recording medium 4 exposed out of the insertion slot 5, by hand, from the image write unit 3. The LCD holder 307 is restored to the position shown in FIG. 8A.

According to this third embodiment, the surface of the LCD panel 35 can be prevented from being scratched, and the need for the lift motor that rotates the LCD holder 307 is eliminated. Therefore, the configuration can be further reduced in size and simplified as compared with the first embodiment. Additionally, lift rollers 313 may be disposed on each of the right and left sides in such a manner as not to pass over the image write display region 4*c* of the display recording medium 4. This can prevent the image write display region 4*c* from being damaged.

Fourth Embodiment

Figure 9A:
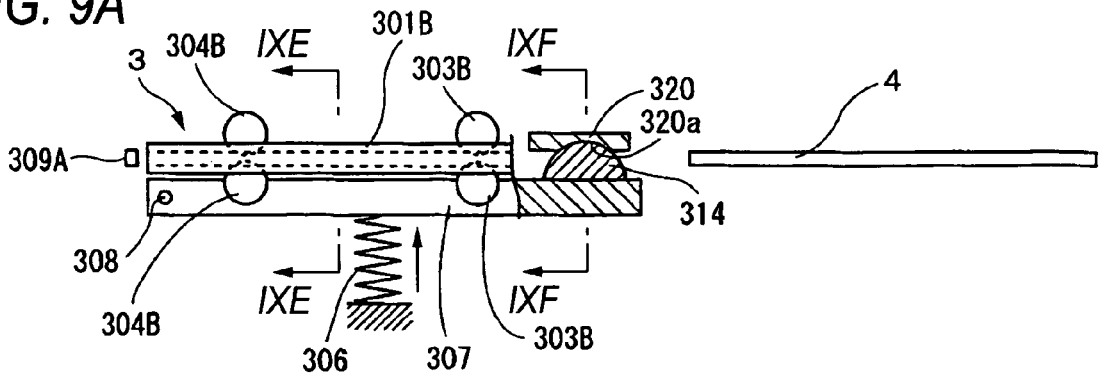
Figure 9B:
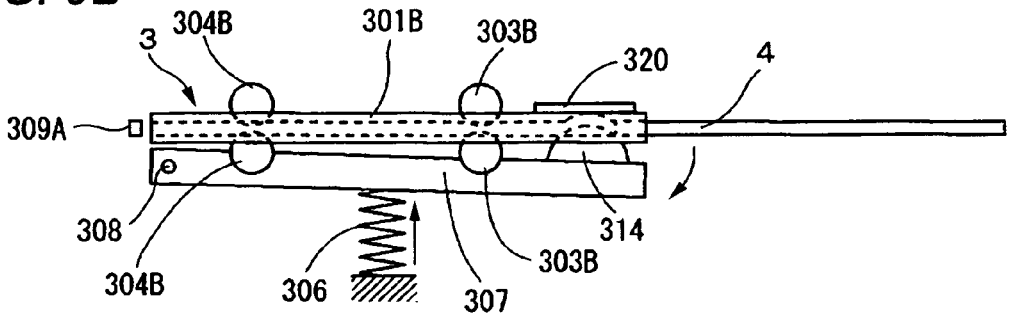
Figure 9C:
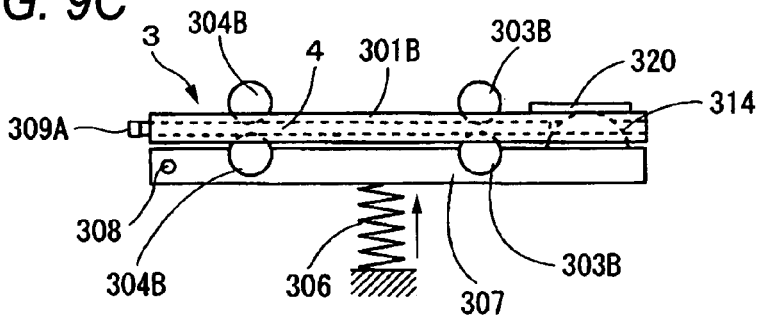
Figure 9D:
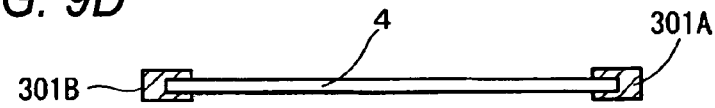
Figure 9E:
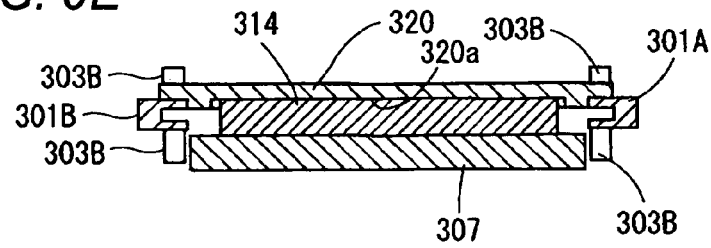

FIG. 9A to 9E shows an image write unit according to a fourth embodiment of the invention. FIG. 9A shows the state of the image write unit before the display recording medium 4 is transported in; FIG. 9B shows the state of the image write unit immediately after the display recording medium 4 is inserted; FIG. 9C shows the state of the image write unit after the display recording medium 4 is completed being transported in; FIG. 9D is a section view taken along line 9D-9D of FIG. 9A; and FIG. 9E is a section view taken along line 9E-9E of FIG. 9A.

This fourth embodiment is configured different from the third embodiment in the following respect. That is, in place of the lift roller 313, a semicircular depressing member 314 made of resin or the like is disposed as a low-friction member. And, a recessed portion 320*a* is provided in the receiving member 320 attached to the guide members 301A and 301B. The other configuration is the same as that of the third embodiment.

The depressing member 314, having a half-column shape obtained by halving a columnar shape, is fixedly mounted on the upper surface of the LCD holder 307. The depressing member 314 may be integrally formed of resin or the like with the LCD holder 307 by injection molding. Besides, the depressing member 314 may be integrally formed of metal such as aluminum with the LCD holder 307, and the surface of the depressing member 314 may be coated with resin such as tetrafluoroethylene resin.

(Operation of Image Forming Apparatus)

When, as shown in FIG. 9A, the display recording medium 4 is inserted between the guide members 301A and 301B from the right as seen in the figure, as shown in FIG. 9B, the leading end of the display recording medium 4 rides over the upper surface of the depressing member 314 and thus depresses the depressing member 314. A gap of such a size that the display recording medium 4 makes no contact with the surface of the LCD panel 35 is thereby provided under the lower surface of the display recording medium 4.

When the display recording medium 4 is further inserted and the medium detection sensor 31 detects the further insertion, the control section 20 drives the not-shown transport motor to rotate the transport rollers 303A, 303B, 304A, and 304B. The leading end of the display recording medium 4 abuts the stopper 309A, and the display recording medium 4 is thus transported to the write position shown in FIG. 9C. The subsequent operation is similar to that of the third embodiment, and thus is omitted from the description.

According to this fourth embodiment, the LCD holder 307 has a greater depression angle than in the third embodiment, so that, even when a curved display recording medium 4 is used, the LCD panel 35 can be prevented from scraping thereagainst. Additionally, depressing members 314 may be disposed on each of the right and left sides in such a manner as not to pass over the image write display region 4*c* of the display recording medium 4.

Fifth Embodiment

Figure 10:
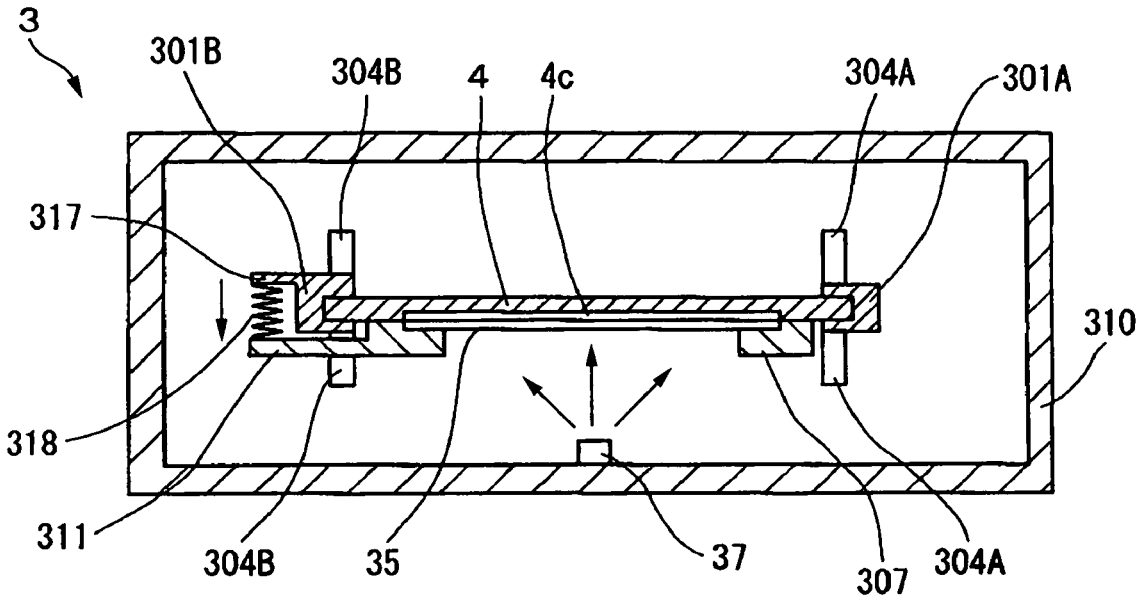
FIG. 10 is a section view showing an image write unit according to a fifth embodiment of the invention.

FIG. 10 shows an image write unit according to a fifth embodiment of the invention. This fifth embodiment is configured different from the first embodiment in the following respect. That is, a tension spring 318 is used in place of the compression spring 306, and this tension spring 318 is fastened between the projecting piece 311 provided on the LCD holder 307 and the projecting piece 317 provided on the guide member 301B. The other configuration is the same as that of the first embodiment.

According to this fifth embodiment, when the display recording medium 4 is transported in, the LCD holder 307 is depressed by the cams. And, after the display recording medium 4 is transported to the write position, the LCD holder 307 is pulled upward by the tension spring 318, thus bringing the LCD panel 35 into close contact with the display recording medium 4. Therefore, similar to the first embodiment, the surface of the LCD panel 35 can be prevented from being scraped.

Sixth Embodiment

Figure 11:
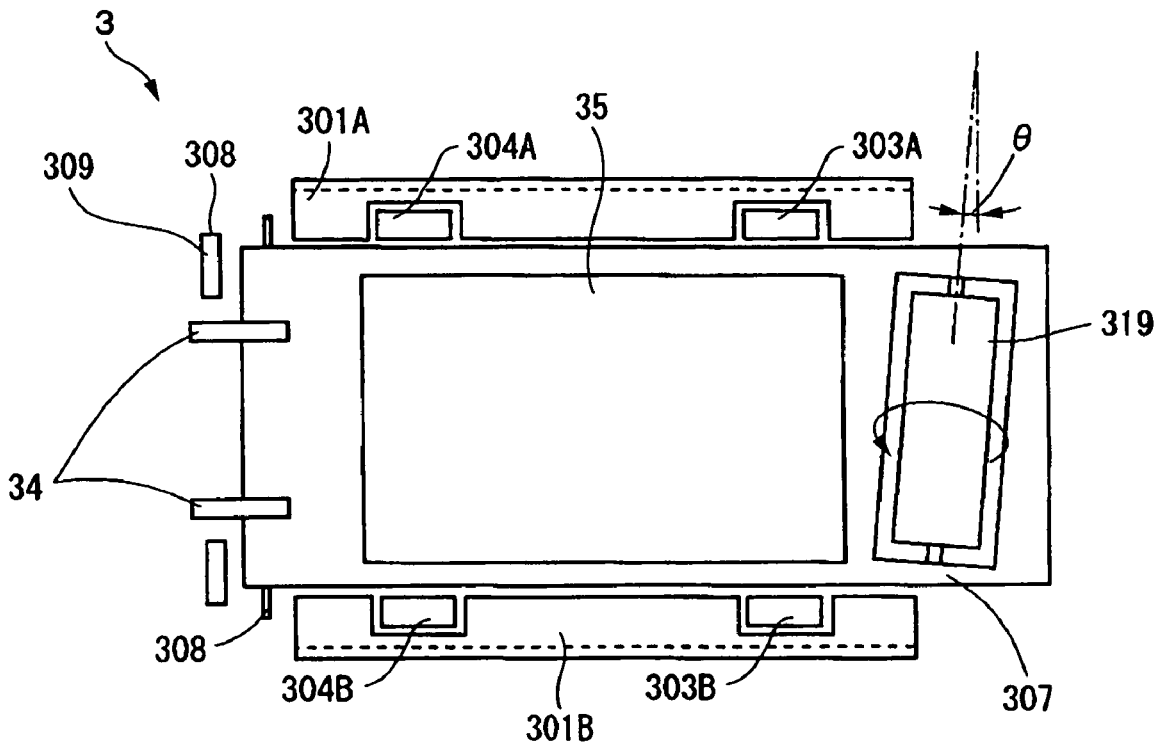
FIG. 11 is a plan view showing the outlined configuration of an image write unit according to a sixth embodiment of the invention.

FIG. 11 shows an image write unit according to a sixth embodiment of the invention. This sixth embodiment is configured different from the third embodiment shown in FIG. 8A to 8E in the following respect. That is, the lift roller 313 is replaced with a roller 319 that is rotatably disposed at an angle θ to the direction of width of the display recording medium 4. The other configuration is the same as that of the third embodiment.

In FIG. 11, when the display recording medium 4 is inserted from the insertion slot 5 of the image write unit 3, in the process where the leading end of the display recording medium 4 is riding over the roller 319, the display recording medium 4 depresses the roller 319 against the spring force of the compression spring 306, thereby depressing the LCD holder 307.

Furthermore, since the roller 319 is attached at a slant, the display recording medium 4 is drawn to the inner side of the guide member 301A in the process of being transported, which prevents the display recording medium 4 from being inclined. Besides, a space occurs between the display recording medium 4 and the LCD holder 307, so that the display recording medium 4 is transported without scraping the surface of the LCD panel 35.

According to this sixth embodiment, the LCD panel 35 can be prevented from being scraped by the display recording medium 4. Besides, the roller 319 disposed at a slant can prevent the display recording medium 4 from being inclined. Therefore, the display recording medium 4 can be smoothly transported, and an image to be recorded can be prevented from being inclined.

Seventh Embodiment

Figure 12A:
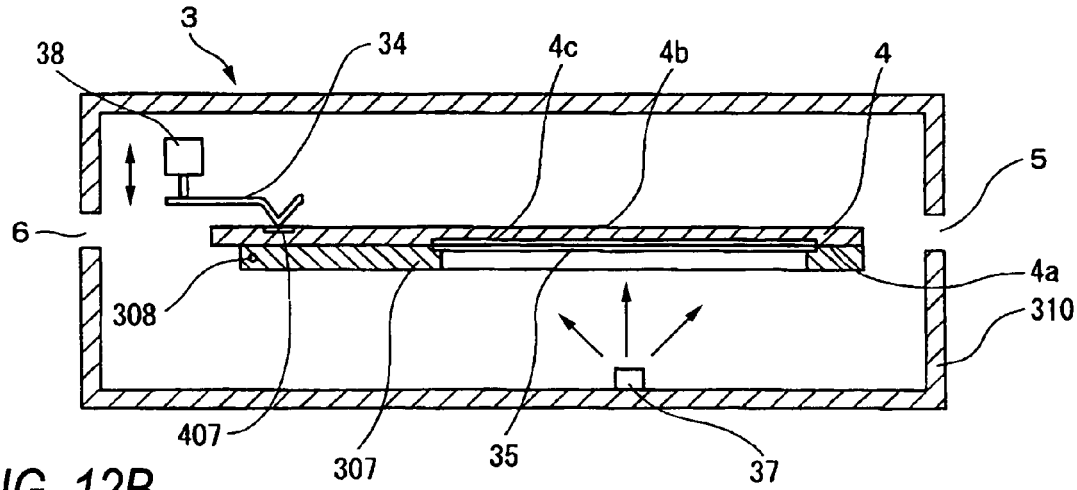
Figure 12B:
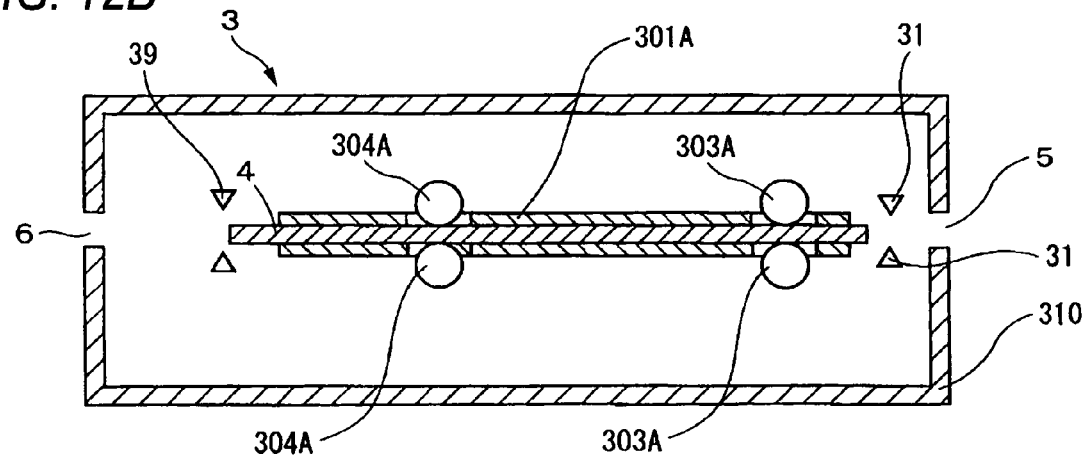
Figure 12C:
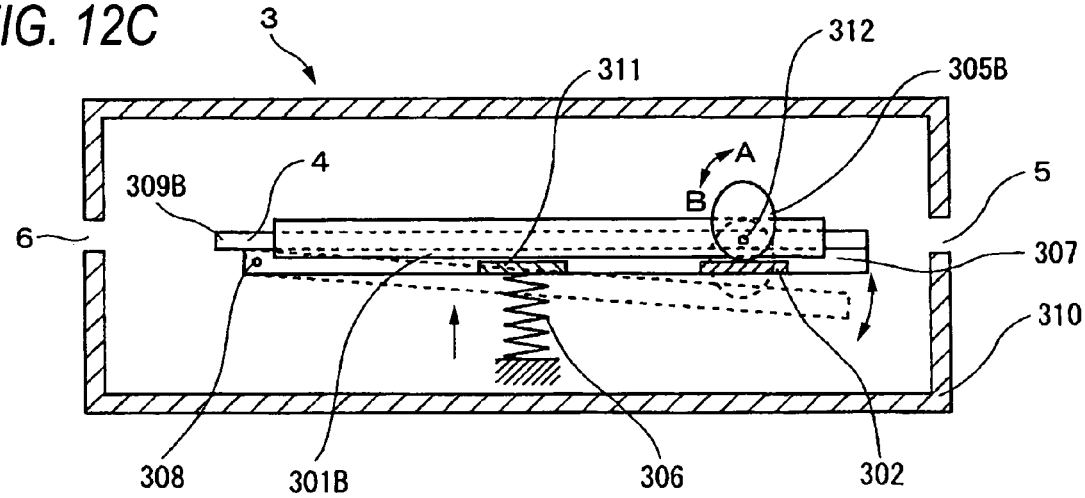

FIG. 12A to 12C shows an image write unit according to a seventh embodiment of the invention. FIG. 12A is a section view taken along line A-A of FIG. 3, FIG. 12B is a section view taken along line B-B of FIG. 3, and FIG. 12C is a section view taken along line C-C of FIG. 3.

This seventh embodiment is configured different from the first embodiment in the following respect. That is, the stoppers 309A and 309B are omitted, and a medium detection sensor 39 is disposed in their place. The leads 34 are adapted to be moved up and down by a solenoid 38, and a discharge slot 6 for discharging the display recording medium 4 is disposed at the rear of the casing 310. The display recording medium 4 can thus be transported out of the rear of the casing 310.

When the display recording medium 4 is transported and the medium detection sensor 39 at the rear detects the leading end of the display recording medium 4, the control section 20 stops the not-shown transport motor. Then, the leads 34 are lowered by the solenoid 38 to abut the receiving ends 407, and an image is written to the image write display region 4*c*. Thereafter, the transport motor is rotationally driven in the forward direction to transport the display recording medium 4 out to the discharge slot 6. The operations of the LCD holder 307 and the like are the same as those of the first embodiment, and thus are omitted from the description.

According to this seventh embodiment, the LCD panel 35 can be prevented from being scraped by the display recording medium 4. And, the display recording medium 4 is adapted to be transported out of the discharge slot 6 provided in the same direction as the transport-in direction. Therefore, write processing can be efficiently performed.

Eighth Embodiment

Figure 13:
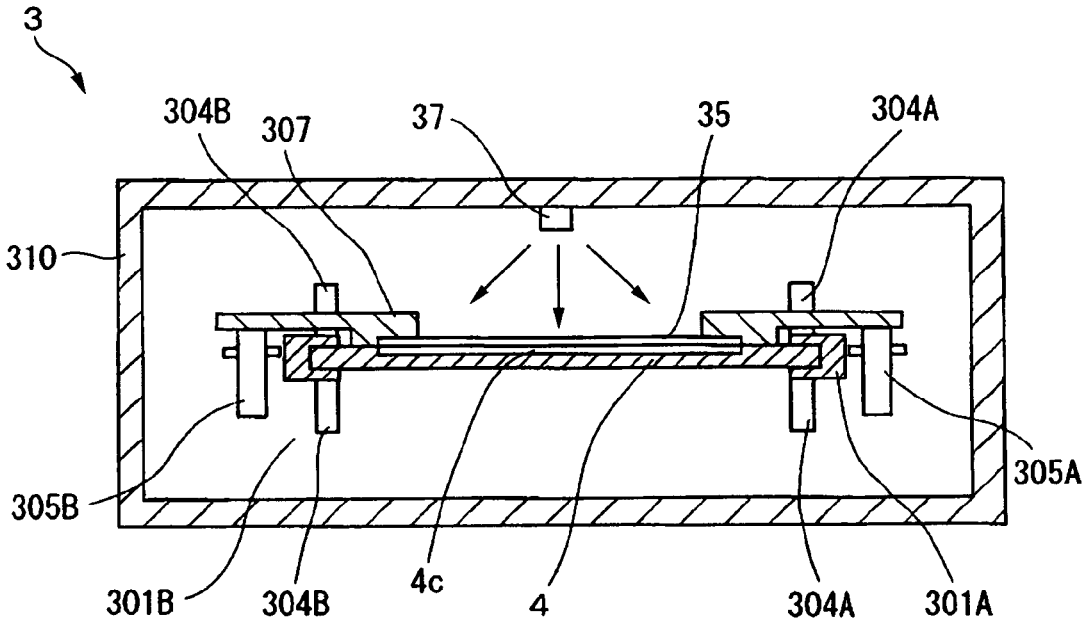
FIG. 13 is a side view showing the configuration of an image write unit according to an eighth embodiment of the invention.

FIG. 13 shows an image write unit according to an eighth embodiment of the invention. This eighth embodiment is configured different from the first embodiment in the following respect. That is, the light source 37, LCD holder 307, and the like are disposed upside down with respect to the guide members 301A and 301B. The other configuration is the same as that of the first embodiment. According to this eighth embodiment, similar to the first embodiment, the LCD panel 35 can be prevented from being scraped by the display recording medium 4. And, the display recording medium 4 is inserted, with the image write display region 4*c* upward, into the insertion slot 5 of the casing 310 and, after a write, is discharged with the same orientation through the discharge slot 5. Therefore, the written image can be immediately observed.

Additionally, even in the second to seventh embodiments, similar to the eighth embodiment, the upside-down configuration can be adopted. In this case, the recessed portion 320*a* is replaced with a through hole, thereby making it possible to prevent dust, dirt, and the like from accumulating therein.

Ninth Embodiment

Figure 14A:
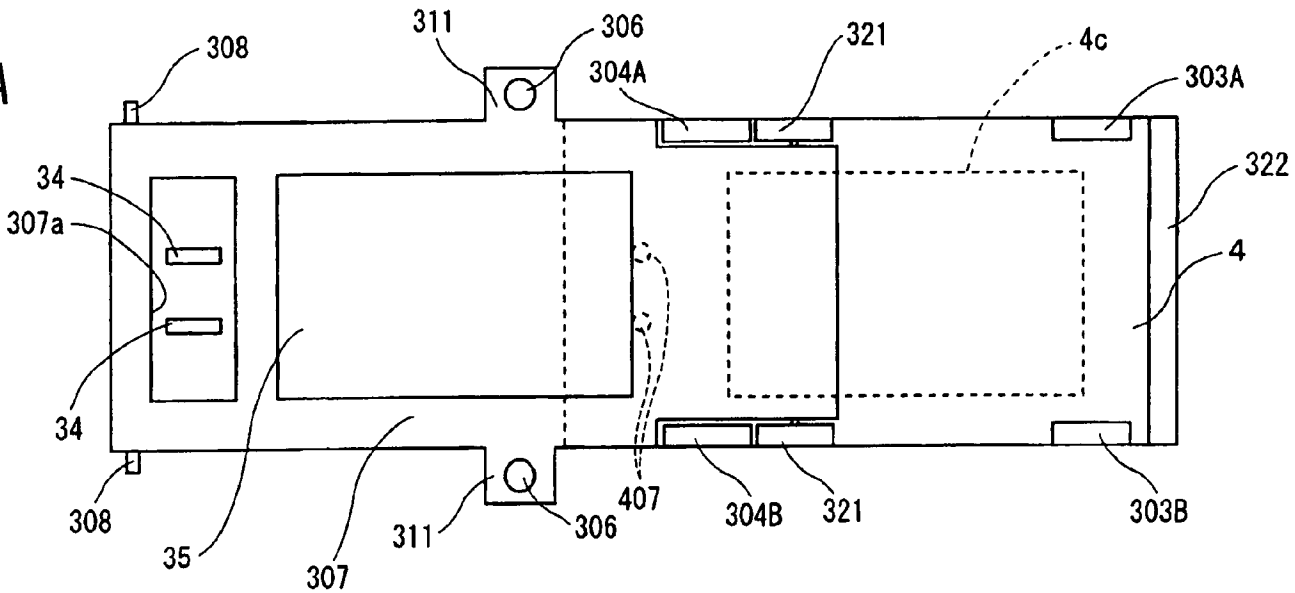
Figure 14B:
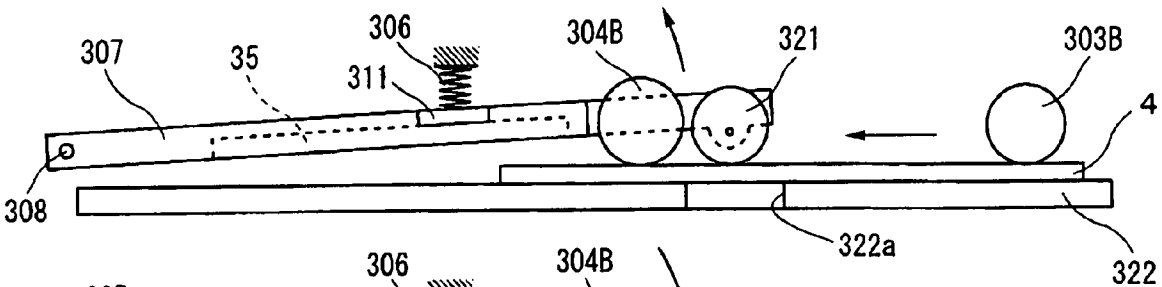
Figure 14C:
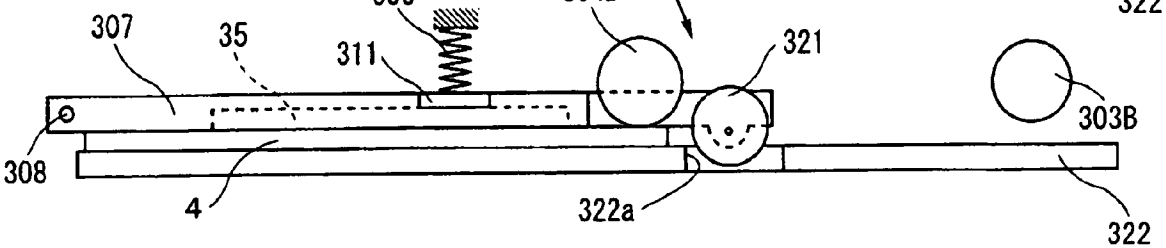

FIG. 14A to 14C shows an image write unit according to a ninth embodiment of the invention. In this ninth embodiment, similar to the eighth embodiment, the light source, LCD holder, and the like are disposed upside down with respect to the guide members as compared with in the first embodiment.

This ninth embodiment has the LCD holder 307 that holds the LCD panel 35 and a guide plate 322 that receives the display recording medium 4 from below. Additionally, the guide members 301A and 301B, medium detection sensor 31, stoppers 309A and 309B, and the like are omitted from the illustration.

The LCD holder 307 has the rotary shafts 308 projecting from its right and left sides, and the position on which the compression spring 306 acts is taken up at a position farther away from the rotary shaft 308 than the center of the LCD panel 35. This can reduce the spring force of the compression spring 306, thus making it possible to reduce the rigidity of the LCD holder 307. Besides, the LCD holder 307 has the leads 34 disposed thereon or an opening 307*a* formed therein. Furthermore, there are provided lift rollers 321 that lift the LCD holder 307.

The guide plate 322, made of light metal such as aluminum, has the surface coated with a resin of tetrafluoroethylene or the like. And, notches 322*a* are provided in the guide plate 322 so as to escape from the lift rollers 321. Additionally, the guide plate 322 may be formed entirely of resin.

According to this ninth embodiment, the use for the lift motor that rotates the LCD holder 307 can be eliminated, which can reduce the size of the configuration. Besides, the notches 322*a* are provided in the guide plate 322, thereby making it possible to increase the lift angle of the LCD holder 307. Therefore, even when the curved display recording medium 4 is used, the LCD panel 35 can be prevented from being scraped thereby. Besides, the transport rollers 303A, 303B, 304A, and 304B and lift rollers 321 are disposed on the right and left sides in such a manner as not to pass over the image write display region 4*c* of the display recording medium 4. Therefore, the image write display region 4*c* can be prevented from being damaged.

Tenth Embodiment

Figure 15:
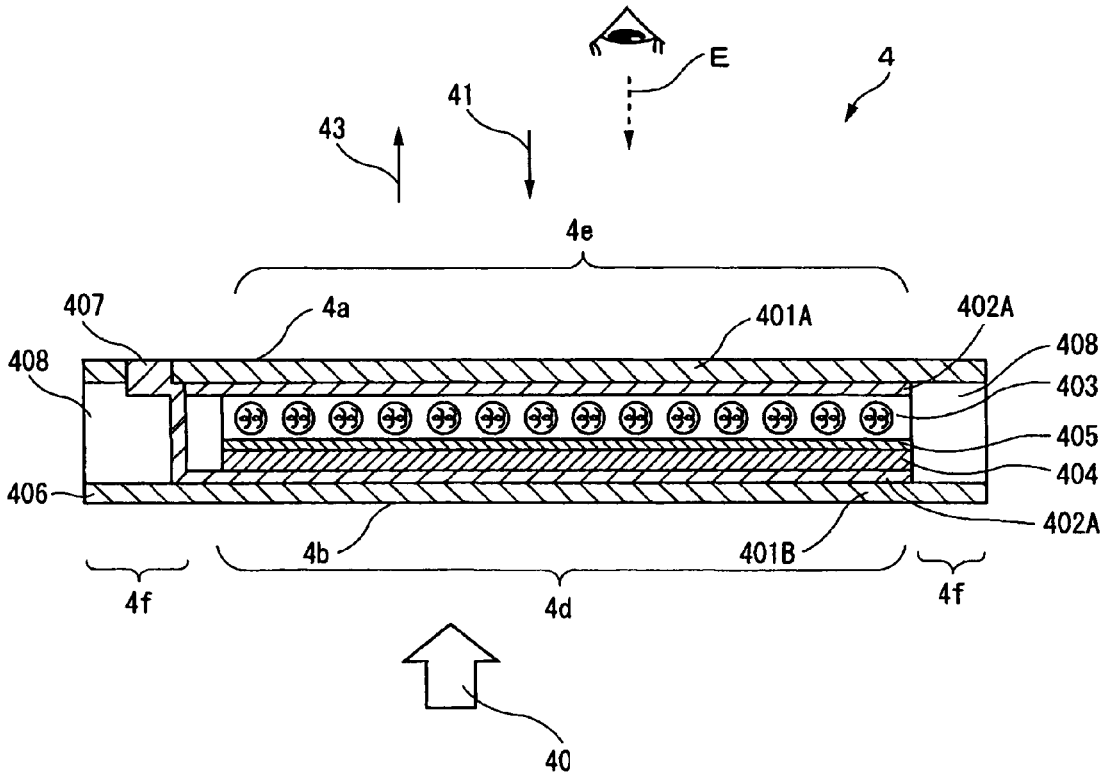
FIG. 15 is a section view showing the layer configuration of an image recording medium according to a tenth embodiment of the invention.

FIG. 15 shows the layer configuration of a display recording medium according to a tenth embodiment of the invention. The display recording medium 4 of this tenth embodiment is of such a type that the direction of irradiation of the write pattern light and the direction of observation are reverse to those in the display recording medium 4 of the first embodiment. And, the entire configuration and the like of the image write unit 3 is the same as those of the first embodiment.

As shown in FIG. 15, this display recording medium 4 is configured different from that of FIG. 6 in that the separation layer is eliminated and the photoconductive layer 404 and the light absorption layer 405 are replaced with each other. The other configuration is the same as that of FIG. 6.

An image write to this display recording medium 4 is performed as follows. That is, an image write region 4*d* is irradiated with the write pattern light 40 from the rear surface 4*b* side and, furthermore, a predetermined voltage is applied to the pair of receiving ends 407 via the leads 34 from the LCD driver 36. Additionally, the written image can be observed from direction E shown in FIG. 13.

According to this tenth embodiment, similar to the first embodiment, the LCD panel 35 can be prevented from being scraped by the display recording medium 4. And, the display recording medium 4 is inserted, with the image write display region 4*e* upward, into the insertion slot 5 of the casing 310 and, after a write, is discharged with the same orientation through the insertion slot 5. Therefore, the written image can be immediately observed. Besides, the image write unit of the tenth embodiment can be applied to those of the first to ninth embodiments.

Other Embodiments

Additionally, the invention is not limited to each afore said embodiment, but can be modified in various ways without departing from the point of the invention. The components of each embodiment can be arbitrarily combined without departing from the point of the invention.

According to the image forming apparatus, by the transport-in and -out of the display recording medium, the image light emitting device side is brought out of contact with the display recording medium before the display recording medium is disposed at the write position, and is brought into proximity to the display recording medium at the write position. An image write is thereby achieved while preventing the contact therebetween. Additionally, various display devices of electric field drive type, such as a liquid crystal layer, an electrophoresis layer, and an EL layer, can be used as the display layer on which the image is displayed in response to the electric field distribution generated by irradiating the photoconductive layer with the two-dimensional image light.

The configuration may be such that the image light emitting device is held by a holder that is pivotally supported so as to be rotatable on the side thereof in the transport-in direction of the display recording medium, and such that the separating/contacting unit includes rotating unit that rotates the holder to bring it out of contact with the write position. The image light emitting device may be moved in a direction perpendicular to the image light emitting surface, but the separating/containing mechanism can be simplified in configuration by rotating the image light emitting device.

The rotating unit may be configured to include a spring member that presses the holder against the display recording medium side and a rotation driver that separates the holder from the display recording medium against the pressing force of the spring member. The spring member is used as the member that presses the holder against the write position side, thereby obtaining stable pressing force. Various springs can be used as the spring member such as a compression spring, a tension spring, a leaf spring, a torsion spring, a spiral spring and a conical spring washer. In this case, the rotation driver may be configured to include a cam that separates the holder from the display recording medium and a cam driver that rotationally drives the cam. Such a cam mechanism can accurately rotate the holder. As the cam, various cams can be used such as an eccentric cam and a plate cam.

The rotating unit may be configured to include a rotary member that, disposed on the holder, separates the holder from the display recording medium by the operation of transport-in and -out of the display recording medium. According to this configuration, it is possible to omit a drive system for rotating the holder.

As the rotary member, a low-friction member that is in slidable contact with the display recording medium to separate the holder from the display recording medium or a rotary member that is in rolling contact with the display recording medium to separate the holder from the display recording medium can be used. The low-friction member may be formed entirely of resin, may be a metal or the like of which surface is coated with a resin such as a tetrafluoroethylene resin, or may be formed integral with the holder.

Besides, the rotary member may be a roller that is disposed inclined to the transport-in direction of the display recording medium. This causes a component force in a direction inclined to the transport direction of the display recording medium. Therefore, a pair of guide members are disposed one on each side of the display recording medium, so that the display recording medium is pushed by one of the guide members, and thus can be prevented from being inclined.

The rotating unit may separate the holder downwardly from the display recording medium in conjunction with the transport-in and -out of the display recording medium. This facilitates supporting of the holder, thus improving a reduction in size of the rotating mechanism.

The transport unit may be configured to transport the display recording medium inserted in the insertion slot into the write position, and to transport the display recording medium written with the image out to the insertion slot. The electrodes in contact with the display recording medium can thereby be held in a fixed state.

The transport unit may be configured to transport the display recording medium inserted in the insertion slot into the write position, and to transport the display recording medium written with the image out to a discharge slot provided at a position that is in the transport-in direction of the display recording medium. The display recording medium is transported out in its transport-in direction, thereby making it possible to efficiently perform write processing.

A flat display is preferably used as the image light emitting device. The apparatus can be reduced in thickness by using a thin-shaped display. As the flat display, various display can be used, for example, an LCD (Liquid Crystal Display), an ELD (Electro Luminescence Display), a PDP (Plasma Display Panel), a VFD (Fluorescent Display Tube Display), an LED (light Emitting Diode) display, and an FED (Field Emission Display).

According to embodiments of the present invention, the write light emitting surface side of the image light emitting device is brought separate from and into contact with the display recording medium transported by the transport unit from the insertion portion to the write position. This needs a smaller movable range of the separating/contacting mechanism than in the configuration where the display recording medium transport mechanism is moved as a whole, as a result of which the entire apparatus can be reduced in thickness. A simplification in configuration also becomes advantageous to reduce the size of the apparatus. While thus achieving the reduction in size, it is possible to prevent the image light emitting device from being damaged by the display recording medium being transported.

The entire disclosure of Japanese Patent Application No. 2005-135861 filed on May 9, 2005 including specification, claims, drawings and abstract is incorporated herein by reference in its entirety.

What is claimed is:

1. An image forming apparatus for writing an image to a display recording medium at a write position, wherein the recording medium has a photoconductive layer and a display layer laminated to each other, the display layer displaying in response to an electric field distribution generated by two-dimensional image light irradiated on the photoconductive layer, the apparatus comprising:

an insertion slot into which the display recording medium is inserted;

a transport unit that transports the display recording medium inserted through the insertion slot, into and out of the write position;

an image light emitting device including an emitting surface that emits the two-dimensional image light for irradiating the photoconductive layer at the write position;

a holder holding the image light emitting device, the holder having a projecting piece on one side surface at the center thereof;

a spring member having an upper end engaging the projecting piece of the holder, and being configured to press the holder in a direction of the display recording medium: and a separating/contacting unit that, while the display recording medium is transported by the transport unit, keeps the emitting surface separated from a display recording medium surface when the display recording medium is not at the write position, and that brings the emitting surface into proximity to the display recording medium surface when the display recording medium is at the write position.

2. The image forming apparatus according to claim 1, wherein the holder is rotatably supported to have a free end on the side of the insertion slot; and wherein the separating/contacting unit includes a rotating unit that rotates the holder to bring the image light emitting device separate from and in contact with the display recording medium.

3. The image forming apparatus according to claim 2, wherein the rotating unit includes a rotation driver that separates the holder from the display recording medium against a pressing force of the spring member.

4. The image forming apparatus according to claim 3, wherein the rotation driver includes a cam that separates the holder from the display recording medium and a cam driver that rotatably drives the cam.

5. The image forming apparatus according to claim 2, wherein the rotating unit includes a rotary member disposed on the holder; and wherein the rotary member separates the holder from the display recording medium by using a force acting from the display recording medium when the display recording medium is transported into or out of the write position.

6. The image forming apparatus according to claim 5, wherein the rotary member is a low-friction member that is in slidable contact with the display recording medium to separate the holder from the display recording medium.

7. The image forming apparatus according to claim 6, wherein the display recording medium has a support body having a display surface and a frame, the frame disposed adjacently to and co-planarly with the display surface; and wherein the rotary member is disposed in contact with the frame.

8. The image forming apparatus according to claim 6, wherein the transport unit includes a guide member that guides the display recording medium at least in the vicinity of the write position; and wherein the guide member includes a recessed portion that houses at least a part of the rotary member at a position opposite to the rotary member.

9. The image forming apparatus according to claim 5, wherein the rotary member is in rolling contact with the display recording medium to separates the holder from the display recording medium.

10. The image forming apparatus according to claim 9, wherein the display recording medium has a support body having a display surface and a frame, the frame disposed adjacently to and co-planarly with the display surface; and wherein the rotary member is disposed in contact with the frame.

11. The image forming apparatus according to claim 9, wherein the transport unit includes a guide member that guides the display recording medium at least in the vicinity of the write position; and wherein the guide member includes a recessed portion that houses at least a part of the rotary member at a position opposite to the rotary member.

12. The image forming apparatus according to claim 9, wherein the rotary member is a roller inclined to a transport-in direction of the display recording medium.

13. The image forming apparatus according to claim 2, wherein the rotating unit separates the holder downwardly from the display recording medium in conjunction with a transport of the display recording medium.

14. The image forming apparatus according to claim 1, wherein the transport unit transports the display recording medium inserted through the insertion slot into the write position, and transports the display recording medium written with the image out to the insertion slot.

15. The image forming apparatus according to claim 1, further comprising:

a discharge slot provided at a position that is in the transport-in direction of the display recording medium.

16. The image forming apparatus according to claim 3, wherein the spring member is disposed between both ends of the holder on the free end side thereof.

17. The image forming apparatus according to claim 3, wherein the spring member is disposed at least at two positions between which the emitting surface is disposed in the axial direction of the holder.

18. The image forming apparatus according to claim 1, wherein the image light emitting device includes a flat display.

* * * * *